US005482540A

United States Patent [19]

Trinward et al.

[11] Patent Number: 5,482,540

[45] Date of Patent: Jan. 9, 1996

[54] ELECTROSTATIC PRECIPITATOR FRAME STABILIZER AND METHOD OF OPERATION

[75] Inventors: John G. Trinward, Waterville, Me.; John P. Jabar, Jr., Portsmouth, N.H.

[73] Assignee: Castine Energy Services, Waterville, Me.

[21] Appl. No.: 188,836

[22] Filed: Jan. 31, 1994

[51] Int. Cl.[6] ..... B03C 3/70

[52] U.S. Cl. ..... 95/57; 96/88; 96/89

[58] Field of Search ..... 96/86–89, 91, 96/92; 95/57

[56] References Cited

U.S. PATENT DOCUMENTS

| | | | |
|---|---|---|---|
| 1,393,712 | 10/1921 | Steere et al. | 96/89 X |
| 1,856,225 | 5/1932 | Ruder | 96/88 |
| 3,755,611 | 8/1973 | Queck et al. | 96/88 X |
| 3,972,701 | 8/1976 | Teel | 96/88 |
| 4,117,255 | 9/1978 | Kawaike et al. | 96/88 X |
| 4,294,591 | 10/1981 | Kahl | 96/88 X |
| 5,006,134 | 4/1991 | Knoll et al. | 96/88 |

FOREIGN PATENT DOCUMENTS

| | | | |
|---|---|---|---|
| 235046 | 8/1961 | Australia | 96/91 |
| 1-258754 | 10/1989 | Japan | 96/88 |

*Primary Examiner*—Richard L. Chiesa

*Attorney, Agent, or Firm*—Chris A. Caseiro; Thomas L. Bohan

[57] ABSTRACT

A grid-frame stabilizer and method of operation for an electrostatic precipitator includes a rigid stand-off member that prevents oscillation of a grid frame used to keep discharge electrodes of the precipitator separated from one another. One end of the stand-off member is rigidly connected to the grid frame and the other end is rigidly connected to a fixed housing component through at least one electrical isolator. The fixed housing component is firmly affixed to an interior region of the precipitator. The stand-off member passes into the housing component through a housing opening which is preferably sealed by a membrane designed to prevent particle contamination of the surfaces of the electrical isolators.

11 Claims, 5 Drawing Sheets

ELECTROSTATIC PRECIPITATOR FRAME STABILIZER AND METHOD OF OPERATION

BACKGROUND OF THE INVENTION

1. Field of the Invention

This invention relates to electrostatic precipitators. More particularly this invention relates to an apparatus for stabilizing the grid frame used to keep the charged wires of an electrostatic precipitator separated from each and from swaying.

2. Background of the Invention

Electrostatic precipitation is a well known method of removing particles from polluted exhaust gas produced from, for example, industrial processes or by oil-fired electric power generation. A simple electrostatic precipitator consists of a grounded tube through which exhaust gas passes, and a wire located in the center of the tube. The placement of a large voltage between the discharge wires and grounded walls of the precipitator causes a corona discharge to occur. Particles in the exhaust gas are ionized in the corona discharge and are moved by the electric field to the grounded walls of the container where they collect for subsequent removal. Because the particles are removed from the gas stream, the exhaust ultimately released into the air has a lower solids content. In order for this procedure to be effective and efficient, it is important to maintain the greatest potential differential possible between the wire (the high-potential component) and the grounded tube.

Large precipitators can be several stories high. They require the use of very high potentials—on the order of 50,000 volts or more—and very long charged wires so as to increase particle-removing effectiveness. Usually these precipitators include a plurality of discharge wires placed in a frame, with a plurality of grounded collector electrodes spaced between the wires. In an electrostatic precipitator such as this, the ionized particles are attracted to the collector electrodes where they collect. The collector electrodes are then rapped to shake the collected particles down into a collection hopper. The particles, ash, and any other solid contaminants, are then withdrawn from the hopper.

Electrostatic precipitators, particularly the larger ones as briefly described above, suffer from a problem caused by the electrostatic field surrounding the discharge wires. This field causes the discharge wires to oscillate. As the wires oscillate, they swing toward the collector electrodes—often getting close enough to cause electric arcing. This arcing causes several problems. First, the arcing greatly reduces the electrostatic field strength surrounding the discharge wires, thus reducing the efficiency of the precipitator. Second, the arcing causes pitting—similar to the deterioration observed on electric switch contacts—of the collector surfaces and discharge wires by physically removing pieces of those components.

One way to reduce oscillation is to attach weights or "bottles" to the bottom ends of the discharge wires. However, in large precipitators weights are ineffective because the electric fields in these precipitators are so strong that oscillation occurs even when the wires are weighted. To overcome this problem weight guide grid systems or frames were developed for large precipitators. A grid system is suspended below the collector electrodes from a top frame and thus is isolated from the grounded shell structure of the precipitator. The grid system is arranged so that weights from the discharge wires are suspended within the system.

The grid reduces, but does not eliminate discharge-wire oscillations. Further, the oscillations of large, high-voltage wires cause the entire grid or frame itself to oscillate or "swing." The frame swing in large precipitators causes the same arcing problems that occur in smaller precipitators due to discharge-wire oscillation.

In an attempt to reduce frame swing, grid frames have been anchored to the wall of the electrostatic-precipitator hopper or other shell structure. However, since the grid, having the same potential as the bottom of the wires, is at a different potential than the grounded hopper or other anchoring points, insulators must be used to anchor the grid. Otherwise, a current path is created between ground and the discharge wires. This can cause a catastrophic short or, at a minimum, it can cause a tremendous loss of electric potential between the discharge wires and the collector electrodes, thus limiting the ability of the precipitator to draw particulate out of the gas stream. Prior-art attempts at anchoring or stabilizing grid systems have proven unsatisfactory because of particle-accumulation-caused shorting currents.

One such prior-art attempt at providing an electrostatic precipitator stabilizer is described in U.S. Pat. No. 3,972,701 issued to Teel. Teel discloses a rigid insulator-stabilizer means connected between the collector electrodes and the weight-guide grid. The stabilizer includes a single, well-known type of rigid ceramic electrical insulator coupled between a top support assembly and a bottom support assembly. The top support assembly is connected to a pair of fixed bottom beams which are connected to the collector electrodes. The top support assembly also includes a sleeve to receive the top portion of the insulator. The bottom support is connected to the grid frame (which is connected to the electrode wires) and includes a cylindrical cup to receive the bottom portion of the rigid insulator. The stabilizer permits the insulator to slide vertically but limits its lateral motion. In effect, the Teel stabilizer prevents grid swing by connecting the grid frame to the fixed bottom beams of the low-potential collector electrodes through the insulating stabilizer.

However, the noted system has at least one significant shortcoming. It places the insulating stabilizers in the direct path of particles falling from the collector electrodes down to the collection hopper. This means that particles will build up on the surface of the stabilizer and thereby create a conducting bridge between the grid frame and the fixed bottom beams. Of course, this bridge of conductive particles can be a path for current. Thus, in the Teel device, a particle layer will inevitably build up creating a path between the high-potential grid frame and the low-potential fixed bottom beams. Current through this particle layer causes a tremendous reduction in the voltage differential between the collector electrodes and the discharge wires and thereby reduces the effectiveness as well as the energy efficiency of the precipitator. This is a common occurrence in electrostatic precipitators utilizing stabilizers in the path of the falling particles.

Teel teaches the use of an unglazed insulator to counteract the effects of particle accumulation on the surface of the insulator. However, it is likely that even the surface of an unglazed insulator will, over time, be oxidized due to transient currents in the particles that accumulate on the insulator. When oxidized, the insulator can become conductive and it thereby creates a permanent current path—until the insulator is replaced—between the grid frame and the collector electrodes. Further, Teel does not address the problem of particle accumulation on other parts of the stabilizer, which also may cause shorting currents between the grid frame and the collector electrodes. Of course, particle accumulation can be addressed by physical cleaning; however this a costly and time-consuming chore that makes maintenance more burdensome. Furthermore, it is noted that for large precipitators it is extremely difficult to access the discharge area. Often, the scheduled cleaning required to maintain a relatively efficient precipitator can take one to two days—a considerable shutdown time for industrial operations.

Present stabilizers have another deficiency. Stabilizers are subject to stress and, over time, break. Unfortunately, when they break, stabilizers such as the one disclosed by Teel, fall directly into the ash hopper, thereby clogging it. This requires emergency, rather than scheduled, maintenance procedures.

In response to these problems, particularly the problem of particle accumulation, there have been attempts to move stabilizers out of the particle stream. Those attempts involved the use of relatively long support bars to attach the stabilizers to the wire frames. However, such fixes are unsatisfactory because the long support bars used have little lateral stability and hence will not effectively eliminate grid-frame swing. Further, the long support bars are extremely difficult to access, since they are usually far removed from the falling particle stream and are thus well away from the access areas used to work on the grid frame and the ash hopper. In addition to the failure to prevent frame swing and the failure to ease maintenance difficulties, these and other similar stabilizer "fixes" are very expensive to produce.

Hence, what is needed is a grid-frame stabilizer that eliminates grid-frame swing so that arcing between the discharge wires and collector electrodes is prevented. Further what is needed is a stabilizer that is not susceptible to particle build-up so that the creation of shorting, particle-layer-current paths between the discharge wires and ground is prevented. Still further, what is needed is a grid-frame stabilizer that significantly reduces maintenance requirements and that is relatively inexpensive with respect to other similar devices used to reduce the problems associated with frame swing in electrostatic precipitators.

SUMMARY OF THE INVENTION

Accordingly it is an object of the present invention to provide an electrostatic-precipitator-frame stabilizer that improves the effectiveness and energy efficiency of a precipitator. It is a further object of the present invention to prevent grid frame swing. It is a yet further object of the present invention to prevent arcing between the precipitator's collector electrodes and its discharge wires. It is a still further object of the present invention to prevent conduction from the grid frame to ground. It is also an object of the present invention to provide a frame stabilizer that prevents particle accumulation. Another object of the present invention is to provide a frame stabilizer that is easy to maintain and that is relatively inexpensive to produce.

These objectives are accomplished by providing an electrostatic-precipitator-frame stabilizer having a rigid stand-off member that fixes that fixes the frame in position. A portion of the stand-off member is placed inside a fixed housing component, with electrical isolators used to attach the stand-off member indirectly to the inside of the fixed housing component. The fixed housing component is attached to a fixed structure, for example, a collection or ash hopper. A membrane is placed over the opening of the housing component, with the stand-off member extending through the membrane so as to prevent particles from contacting the electrical isolators located inside the fixed housing component.

The present invention thus provides a secure connection of the suspended grid frame to a fixed structure. By securing the grid frame to the fixed structure via the indirectly-coupled stand-off member, grid-frame swing is eliminated and arcing between the discharge wires and collector electrodes is thereby prevented. By electrically isolating the stand-off member from the housing component, the discharge wires connected to the grid are electrically isolated from the grounded anchoring structure. In this way, the primary goal of preventing shorts between the electrodes is achieved while the potential difference between those electrodes is maintained. Additionally, in order to prevent the shorting that occurs over a period of time as a result of a conduction path created by particle build-up, the falling particles are captured either on the membrane covering the housing, or on the exterior of the housing, rather than on the isolators located entirely within the housing. A portion of the captured particles fall into the hopper below, with the rest remaining on the membrane and/or the housing until a scheduled maintenance. The arrangement described prevents particle accumulation on the isolators and thus eliminates the possibility of providing a current through particles on the isolators from the stand-off member to the fixed housing component. Hence, by preventing arcing and shorting, the objective of maintaining precipitator effectiveness and energy efficiency is achieved.

An important feature of the stabilizer of the present invention is that the conductive surfaces of the housing component and like surfaces of the stand-off member are spaced apart so as to prevent an accumulation of particles from contacting the housing component and the stand-off member simultaneously. Preferably, at least a portion of the stand-off member is oriented within the electrostatic precipitator in the same direction as the flow of particles, so as to minimize particle accumulation thereon. Further the housing component may alternatively include a curved top to minimize particle buildup. An optional feature of the present invention is the introduction of a particle deflector which may be mounted on the various components so as to reduce particle build-up on such surfaces. This aids in preventing particle accumulation and, hence, eliminates shorting.

A key advantage of the present invention is its location within the precipitator system. Because the stabilizer of the present invention is designed so that particle buildup thereon is minimized and isolated, the stabilizer may be located within the ash hopper, in the direct flow of collected particles. In so doing, the possibility of a failed component, such as an isolator, falling into and clogging the hopper is eliminated, as the housing will catch the failed component—without compromising the isolation of the grid frame from the grounded electrode. This eliminates clogging of the ash hopper of the type that was associated with the prior art.

Fixing the stabilizer within the hopper—or a similar collection device of the precipitator—greatly reduces the required length of the stand-off member, thereby increasing the lateral stability conferred to the grid frame. This location also makes access to the stabilizer for maintenance much easier. It is to be further noted that access to the stabilizer is much easier when placed near the interior walls of the hopper. As a result, maintenance is much easier, effectively reducing maintenance time from about two days to only a few hours for a typical largescale industrial precipitator. It is also to be noted that the stabilizer of the present invention is fairly simple and relatively small, thus it is inexpensive to produce in comparison to prior devices performing the same function.

These and other aspects and advantages of the present invention will become better understood with reference to the following description, the drawings, and the appended claims.

DESCRIPTION OF THE PREFERRED EMBODIMENT

Figure 1:
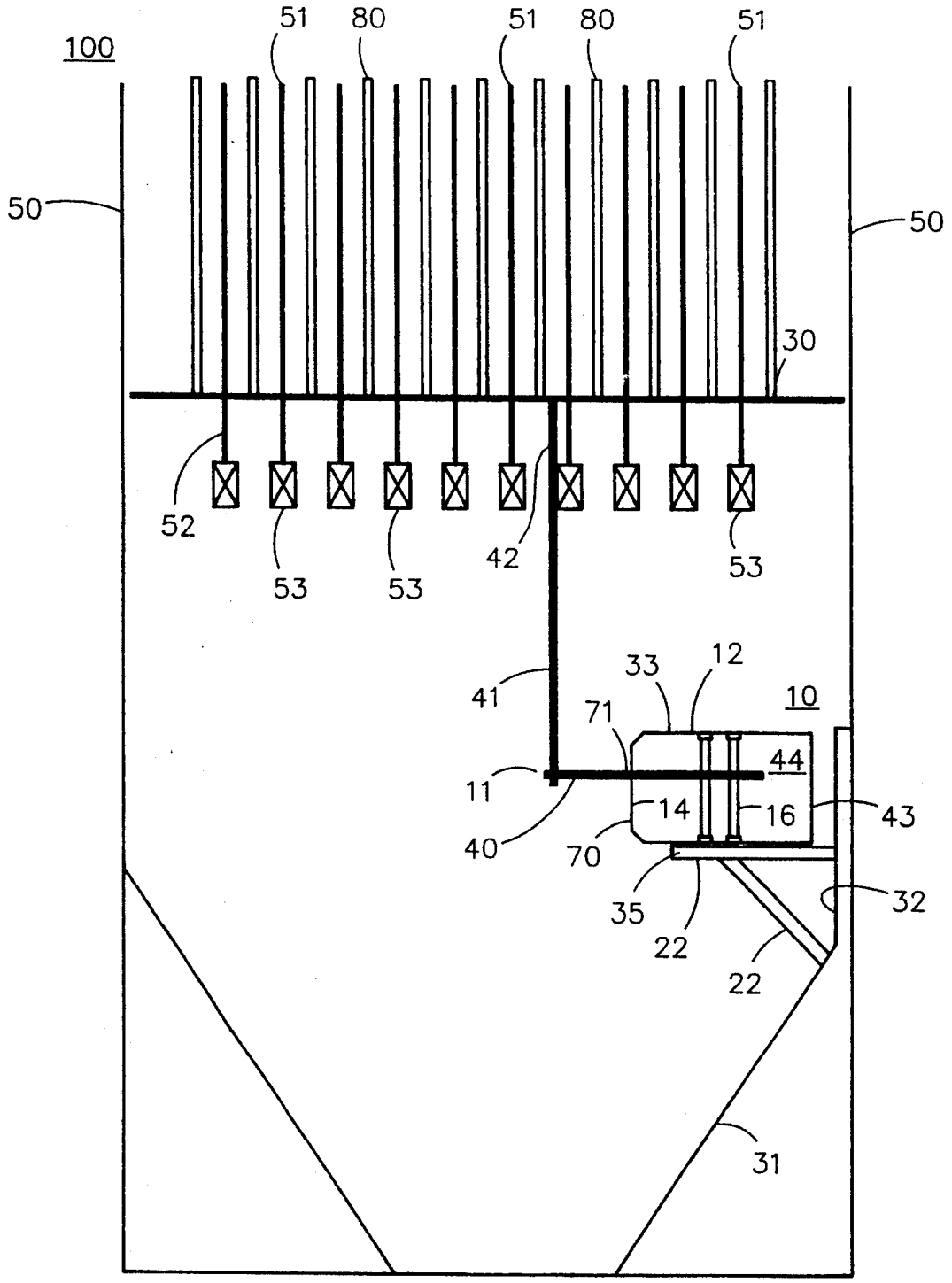
FIG. 1 is a side view showing generally a simplified illustration of a typical electrostatic precipitator with the frame stabilizer of the present invention located therein.
Figure 2:
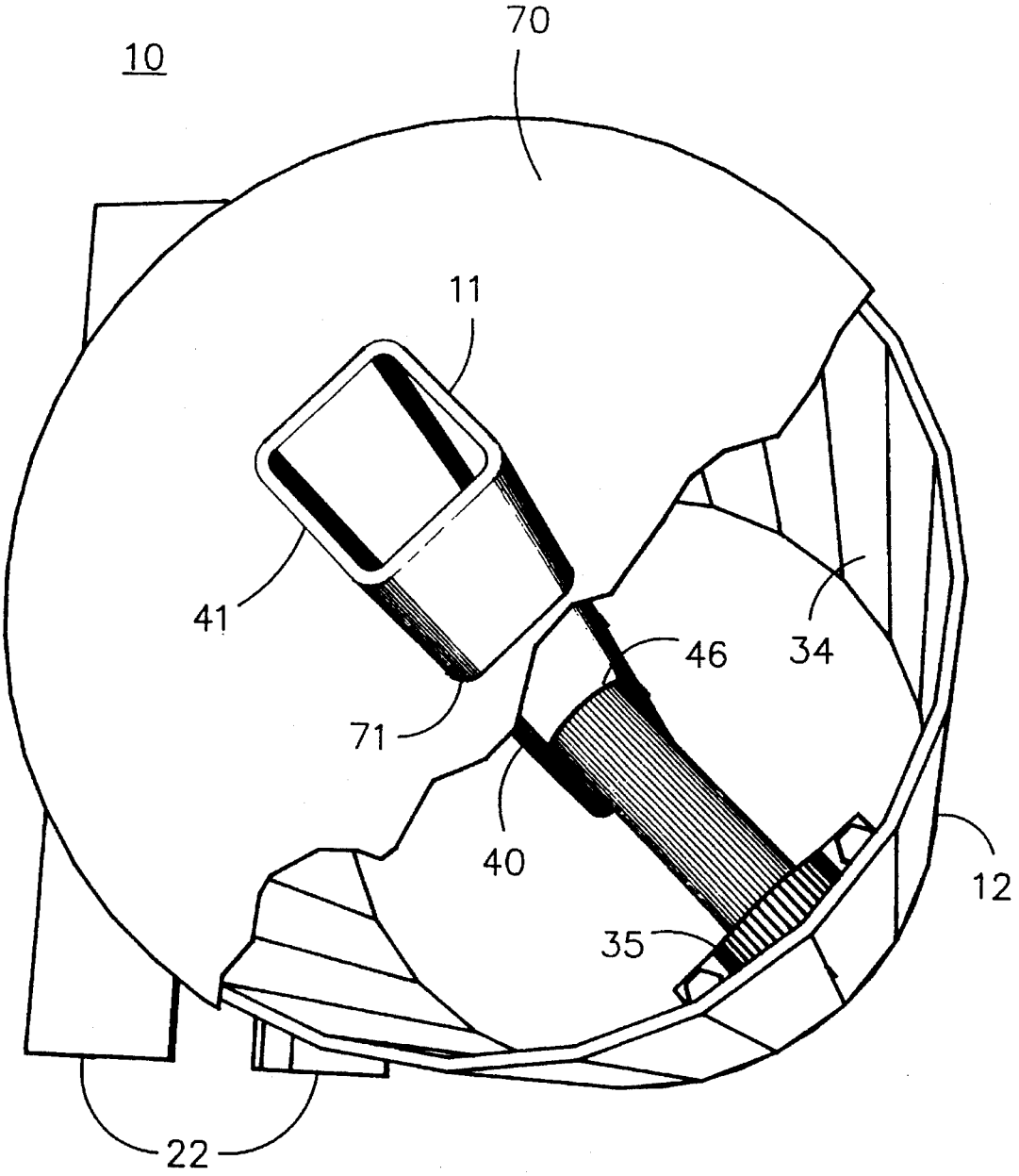
FIG. 2 is a perspective view of the frame stabilizer of the present invention, with a partial cut-away view of the components within the housing and the membrane.
Figure 3:
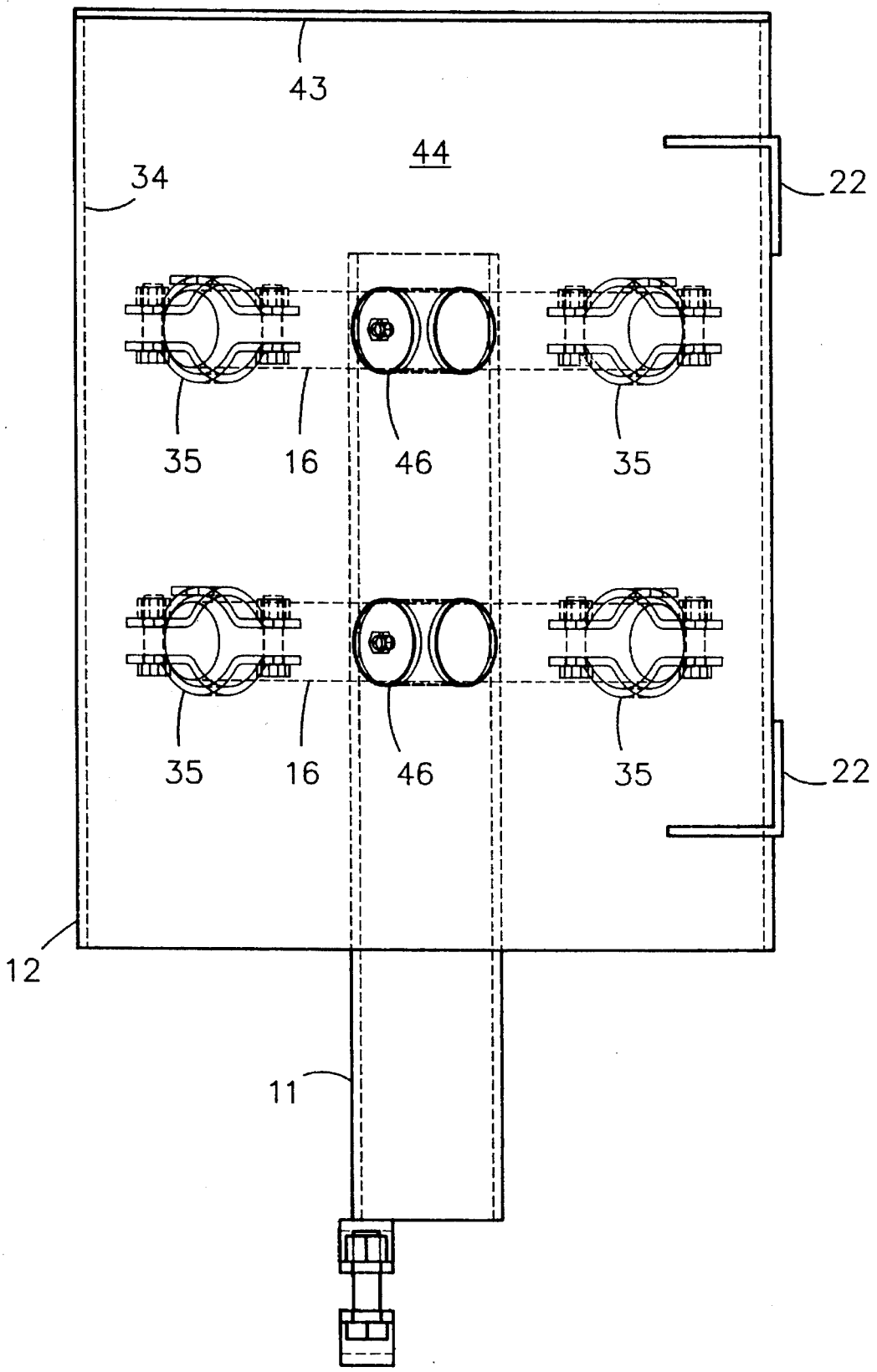
FIG. 3 is a top view of the frame stabilizer of the present invention.
Figure 4:
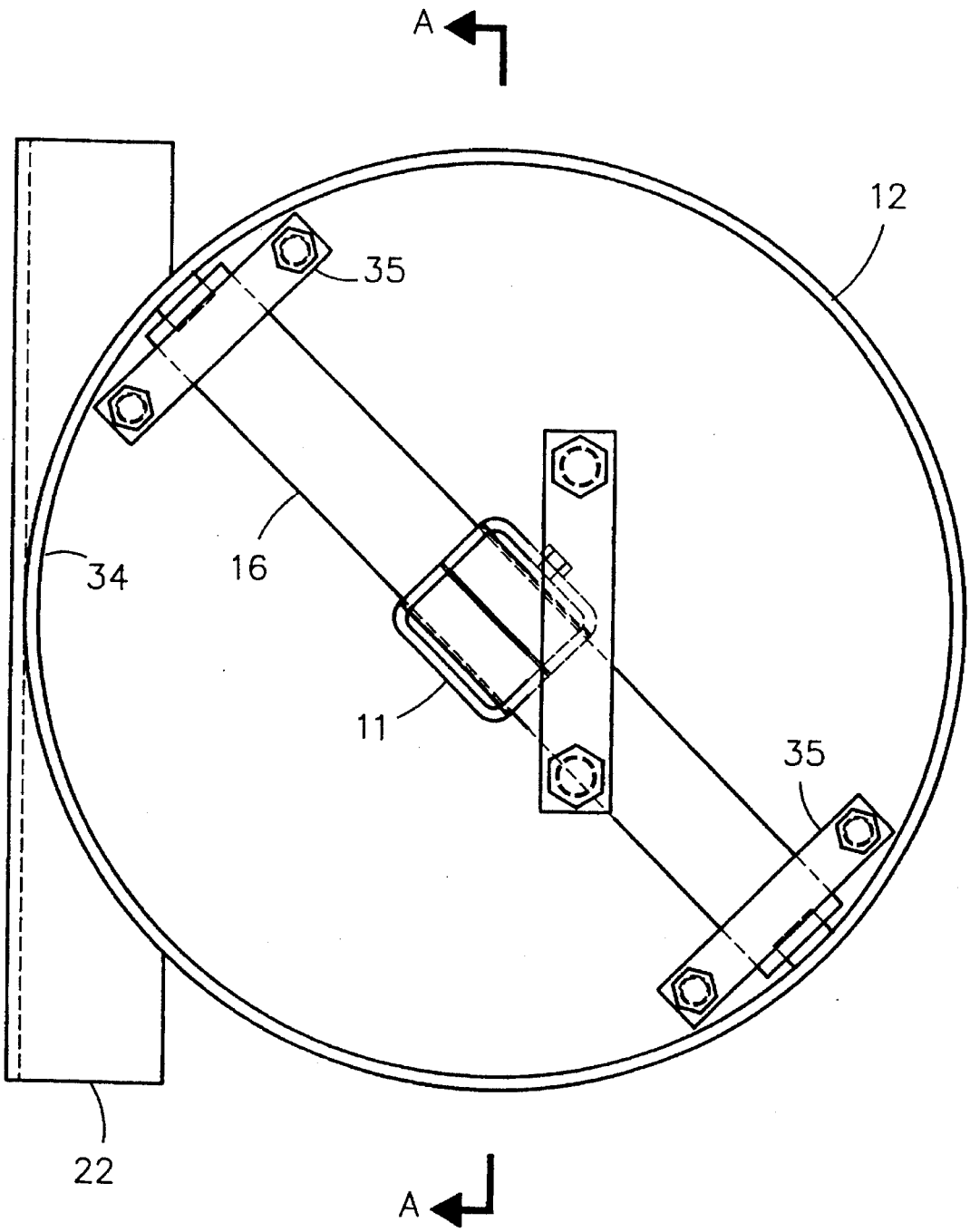
FIG. 4 is a front view of the frame stabilizer of the present invention.
Figure 5:
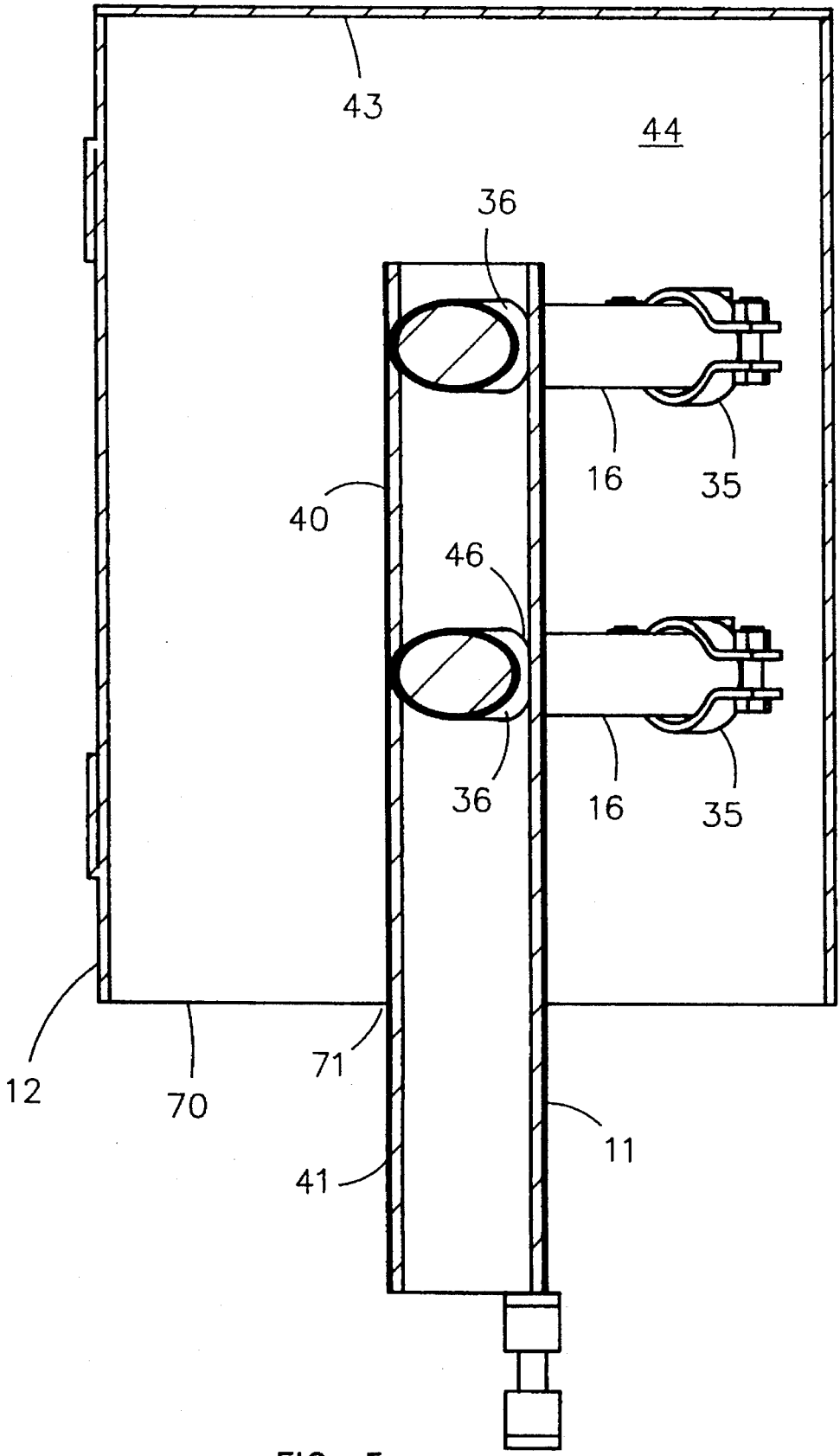
FIG. 5 is a cross-sectional view of the frame stabilizer of the present invention, taken at section A—A of FIG. 4.

A frame stabilizer 10 of the present invention, including a rigid stand-off member 11 and a fixed housing 12, is shown in FIG. 1 as it is positioned within an electrostatic precipitator which is illustrated generally as precipitator 100. The fixed housing 12 has an opening 14 and is, in the preferred embodiment, attached to an ash hopper 31. Directly above the ash hopper 31 is a grid frame 30 of the precipitator 100. The fixed housing 12 must be firmly secured to a hopper sidewall 32 of the ash hopper 31 in order to ensure that the stand-off member 11 will maintain the grid frame 30 in a fixed position throughout precipitation operations. While a variety of means may be used to secure the housing 12 to the ash hopper 31, such as welding it on directly or bolting it on, in the preferred embodiment of the invention for the housing 12 sized as to be described later herein, angle bars 22 are first welded to exterior housing walls 33 and then bolted or welded to the hopper sidewall 32. It is to be noted that for most electrostatic precipitators, locating the stabilizer 10 on the hopper sidewall 32 makes access for maintenance much easier. As can be seen in FIG. 1, the stabilizer 10 is oriented so that the stand-off member 11 runs parallel to the direction of falling particles so that accumulation thereon is minimized.

The precipitator 100 includes precipitator sidewalls 50. As with most largescale precipitators, the precipitator 100 also includes collector plates 80 that are at low potential and that act to collect particles in a gas stream passing through the precipitator 100. The precipitator 100 also includes a plurality of discharge wires 51 that are at a high potential and that act to ionize the particles so that they migrate to the precipitator sidewalls 50. Typically, the collector plates 80 are about 9–12 inches apart, with the discharge wires 51 located therebetween. Wire bottoms 52 of the discharge wires 51 pass through the grid frame 30 so that the discharge wires 51 remain isolated from one another and so that swaying of the discharge wires 51 is minimized. Weights 53 fixed to the wire bottoms 52 further act to reduce swaying of the discharge wires 51. In some cases there can be as many as 18,000 or more discharge wires 51 in a typical precipitation operation. It is to be noted that while the simplified view of the system illustrated in FIG. 1 may show the discharge wires 51 and the collector plates electrically coupled via the grid frame 30, it is to be understood that such is not the case, as the collector plates 80 do not contact the grid frame 30. In any event, FIG. 1 is designed to show the relationship of the stabilizer 10 of the present invention to a precipitator.

Fixed housing 12, made of a metal such as Aluminum, has an inside diameter of about 1.5 feet, with a wall thickness of about ¼-inch. Of course, it is to be understood that the housing may be made of other suitable materials, including steel and plastic, and that it must be sized to serve the function of the particular precipitator to which it is attached. As further illustrated in FIGS. 2–5, a bottom housing plate 43 of the same diameter as the inside diameter as the housing 12, is secured to a lower housing region 44 and seals the bottom of the housing 12 so that no component within the housing 12 will accidently fall into the ash hopper 31. An alternative and preferable addition to the housing 12 is a housing membrane 70 designed to keep falling precipitate from entering the housing 12 via the housing opening 14. Use of the housing membrane 70 further reduces the amount of maintenance involved in keeping the potential difference between the precipitators electrodes as large as possible. The membrane 70 covers the entire housing opening 14 and has a membrane opening 71 through which the stand-off member 11 passes. The membrane opening 71 is preferably sized so that it is in contact with the stand-off member 11, effectively producing a seal between the two in order to ensure that little, if any, particles fall into the housing 12. While the membrane 70 may be fabricated of a wide array of non-conducting materials, including plastic or rubber, it is preferably made of a heat-and fire-resistant cloth such as glass-fiber cloths and others well know by those skilled in the art. Optionally, the membrane 70 may be formed in a conical shape so that falling particles slid off of it rather than gather on its surface.

The stand-off member 11, which must be made of a rigid material such as steel, includes a lower member portion 40 located within and extending through the fixed housing 12. An upper member portion 41 rigidly fixed to the lower member portion 40 at a right angle thereto in the preferred embodiment of the invention, ends in a stand-off member top 42 that is affixed to the grid frame 30 as illustrated in FIG. 1. Alternatively, the upper member portion 41 may be coupled to the grid frame 30 via a loop located in the grid frame member 30. In the preferred embodiment of the present invention, the stand-off member 11 is a rectangular steel tube that is about 3 inches by 3 inches, with a wall thickness of about 7/32-inch. The lengths of the lower member portion 40 and the upper member portion 41 are dependent upon the location of the fixed housing 12 with respect to the grid frame 30 and with respect to the hopper sidewall 32. It is to be understood that although the fixed housing 12 is illustrated as being oriented perpendicular to the precipitator sidewalls 50, it may be placed in a different orientation, such as parallel to those sidewalls 50, without deviating from the scope of the present invention, provided isolation and rigidity are maintained as noted.

While the stand-off member 11 is designed to fix the position of the grid frame 30, it is important to electrically isolate it from the hopper sidewall 32, as previously indicated. This is achieved in the stabilizer 10 of the present invention through the use of one or more isolator bars 16 which are affixed to interior housing walls 34 and are affixed to the lower member portion 40 of stand-off member 11, as illustrated. Although it is possible to utilize a single isolator bar 16 to physically couple the stand-off member 11 to the fixed housing 12, it would be necessary to firmly secure the isolator bar 16 to the lower member portion 40 so that the stand-off member 11 will not rotate thereon. In securing the isolator bar 16 that effectively, it is also necessary to maintain electrical isolation of the stand-off member 11 from the hopper sidewall 32—a difficult task. Therefore, in the preferred embodiment of the present invention, there are two isolator bars 16 spaced apart from each other and passing through the lower member portion 40 so that the stand-off member 11 cannot pivot. In that way, the stand-off member 11, and as a result, the grid frame 30, will remain in a fixed position throughout the precipitation operations.

The isolator bars 16 may be fabricated of well-known electrically insulative materials; that is, materials with very low dielectric values, that are also high-strength materials. In the preferred embodiment of the present invention the isolator bars 16 are made of 2-inch diameter ceramic rod. For the stabilizer 10 with housing 12 and stand-off member 11 components as described, the isolator bars 16 are six inches apart and are affixed to the interior housing walls 34 using isolator rod brackets 35. They may be positioned in parallel to each other or at angles so long as pivoting of the stand-off member 11 is prevented. Additionally, rod gaskets 36 secure the isolator rods 16 within member openings 46 of the lower member portion 40 of the stand-off member 11.

In operation, a high voltage is placed on the discharge wires 51 of the precipitator 100. This voltage creates an electrostatic field around the discharge wires 51 which in turn causes an ionization near the discharge wires 51 and a consequent corona discharge. The corona discharge draws charge from the discharge wires 51 and the replenishment of the charge via the applied high voltage creates a current through the discharge wires 51. That is, in order to maintain the noted electric field so as to cause the particles to move to ground, the high voltage must be maintained. In order to maintain the high voltage in the presence of the corona discharge, it is necessary to replenish the charge flow which constitutes a current. This current through the discharge wires 51 causes them, as well as the frame grid 30 mechanically coupled to the discharge wires 51, to oscillate. Stabilizer 10 connecting grid frame 30 to fixed ash hopper 31 prevents motion of the grid frame 30 and thus motion of the discharge wires 51, while maintaining electrical isolation of the two conductive elements. The isolator bars 16 used to maintain this isolation while also firmly fixing the grid frame 30 to the ash hopper 31, are retained within the housing 12 so that falling particles within the precipitator 100 will not come to rest in regions that will eventually create a conducting bridge between the grid frame 30 and the ash hopper 31 or other similar conductive components that would otherwise electrically couple the electrodes of the precipitator 100 together.

Although the present invention has been described with reference to a particular preferred embodiment, variations on component orientations, materials of fabrication, and methods of attachment, among other features, will be readily apparent to those skilled in the art. Therefore, it is to be understood that alterations and equivalents may be made of the invention as described without deviating from its basic attributes.

We claim:

1. A grid-frame stabilizer for stabilizing a grid frame in an electrostatic precipitator, said grid-frame stabilizer comprising:

a. a fixed housing component including means for securing said housing component to an interior of said electrostatic precipitator;

b. one or more electrical isolators located within said housing component and connected to an interior region of said housing component;

c. a stand-off member attached to said grid frame and to said electrical isolators, wherein a portion of said stand-off member passes through a housing opening of said housing component; and d. a membrane for enclosing said one or more electrical isolators within said housing component, wherein said membrane is positioned over said housing opening, said membrane having a membrane opening through which said stand-off member passes.

2. The grid-frame stabilizer as claimed in claim 1 further comprising an ash deflector connected to said fixed housing component.

3. The grid-frame stabilizer as claimed in claim 2 wherein two electrical isolators are positioned within said housing component and wherein said electrical isolators pass through a lower member region of said stand-off member.

4. The grid-frame stabilizer as claimed in claim 3 wherein said electrical isolators are ceramic rods.

5. An electrostatic precipitator comprising:

a. a grid frame;

b. an ash hopper located below said grid frame; and, c. a grid-frame stabilizer having:

i. a fixed housing component including means for securing said housing component to an interior of said electrostatic precipitator;

ii. one or more electrical isolators located within said housing component and connected to an interior region of said housing component;

iii. a stand-off member attached to said grid frame and to said electrical isolators, wherein a portion of said stand-off member passes through a housing opening of said housing component; and iv. a membrane for enclosing said one or more electrical isolators within said housing component, wherein said membrane is positioned over said housing opening, said membrane having a membrane opening through which said stand-off member passes.

6. The precipitator as claimed in claim 5 with said grid-frame stabilizer further comprising an ash deflector connected to said fixed housing component.

7. The precipitator as claimed in claim 5 wherein two electrical isolators are positioned within said housing component and wherein said electrical isolators pass through a lower member region of said stand-off member.

8. The precipitator as claimed in claim 7 wherein said electrical isolators are ceramic rods.

9. A method of preventing grid-frame swing in a particle precipitator having a grid frame, said method comprising the steps of:

a. securing a stand-off member to said grid frame;

b. electrically isolating said stand-off member from a fixed housing having a housing opening by connecting said stand-off member to said fixed housing through one or more electrical isolators located within said fixed housing; and c. sealing said fixed housing to prevent particle contamination of said electrical isolators by placing a membrane over said housing opening, said membrane having a membrane opening through which said stand-off member passes.

10. The method as claimed in claim 9 further comprising the step of attaching said fixed housing to an interior surface of an ash hopper of said particle precipitator.

11. The method as claimed in claim 10 wherein said electrical isolators are ceramic rods.

* * * * *